United States Patent [19]

Lilliehöök

[11] Patent Number: 4,773,345

[45] Date of Patent: Sep. 27, 1988

[54] FORCE AMPLIFYING DEVICE FOR WINDING A ROPE UNDER TENSION

[76] Inventor: Björn Lilliehöök, Karlsrovägen 35, S-182 64 Djursholm, Sweden

[21] Appl. No.: 893,301

[22] PCT Filed: Oct. 9, 1985

[86] PCT No.: PCT/SE85/00388

§ 371 Date: Jun. 20, 1986

§ 102(e) Date: Jun. 20, 1986

[87] PCT Pub. No.: WO86/02332

PCT Pub. Date: Apr. 24, 1986

[30] Foreign Application Priority Data

| | | | |
|---|---|---|---|
| Oct. 9, 1984 | [SE] | Sweden | 8405044 |
| Feb. 26, 1985 | [SE] | Sweden | 8500932 |
| Jun. 24, 1985 | [SE] | Sweden | 8503111 |

[51] Int. Cl.[4] ..... B63H 9/10

[52] U.S. Cl. ..... 114/39.2; 114/90; 114/97; 114/109; 254/375

[58] Field of Search ..... 114/39.2, 103, 104, 114/105, 108, 109, 90, 97; 254/356, 375

[56] References Cited

U.S. PATENT DOCUMENTS

| | | | |
|---|---|---|---|
| 2,561,253 | 7/1951 | Wells-Coates | 114/103 |
| 2,919,108 | 12/1959 | Buechting | 254/375 |
| 3,228,372 | 1/1966 | Ridder et al. . | |
| 3,452,700 | 1/1969 | Horgan, Jr. . | |
| 3,867,896 | 2/1975 | Merry | 114/109 |
| 4,469,040 | 9/1984 | Gougeon et al. . | |

FOREIGN PATENT DOCUMENTS

| | | | |
|---|---|---|---|
| 2422551 | 9/1979 | France | 114/39.2 |
| 2835827 | 2/1979 | Fed. Rep. of Germany . | |

*Primary Examiner*—Sherman D. Basinger
*Attorney, Agent, or Firm*—Finnegan, Henderson, Farabow, Garrett & Dunner

[57] ABSTRACT

A force amplifying device for stretching sail and riggings of a sailing device. The device includes a rope drive for winding up a rope under tension arranged in an elongated housing with the axis of the rope drum directed essentially perpendicular to a longitudinal extension direction of the housing. An elongated crank arm is arranged outside the housing in a force transferring connection to the rope drum for turning the rope drum and winding up a rope under tension on the rope drum. At least one locking arrangement is provided for locking the crank arm in a direction which substantially coincides with the longitudinal extension direction of the elongated housing.

9 Claims, 4 Drawing Sheets

FIG. 5
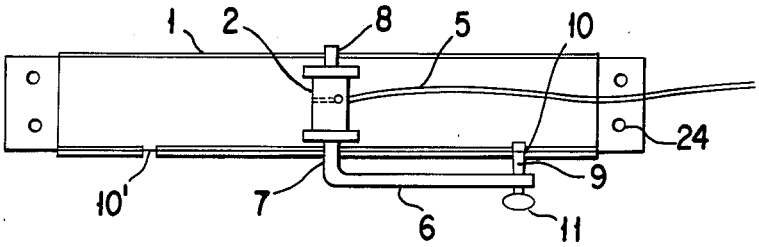
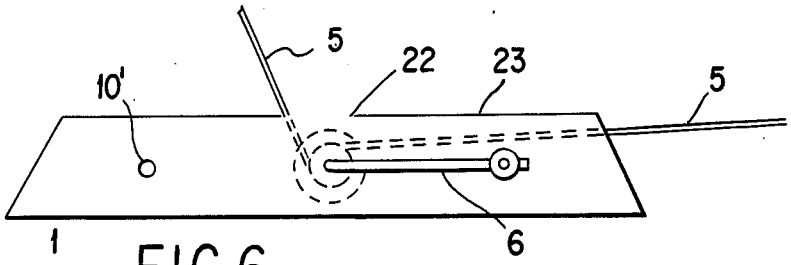
FIG. 6
FIG. 7
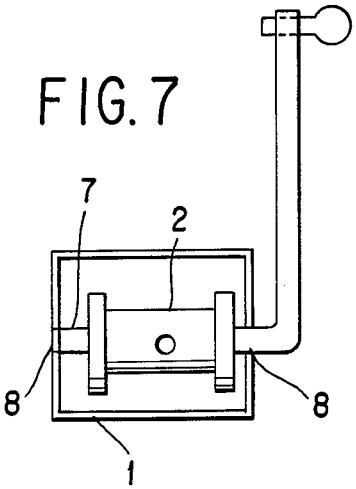
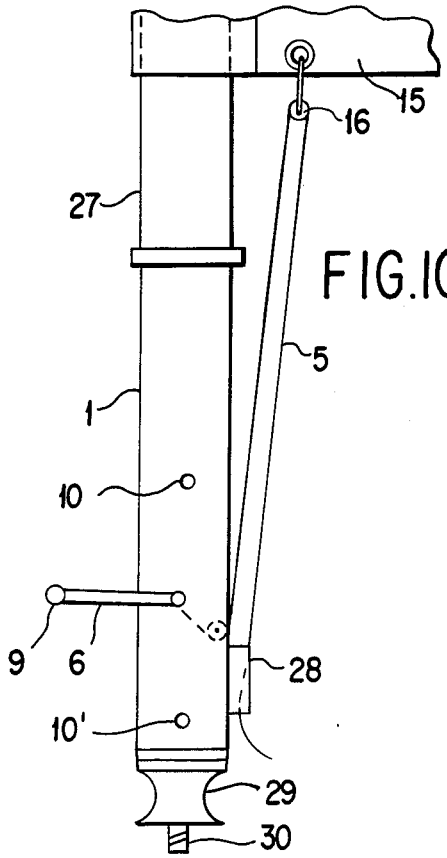
FIG. 10

FORCE AMPLIFYING DEVICE FOR WINDING A ROPE UNDER TENSION

BACKGROUND OF THE INVENTION

The development within the windsurfing area is towards higher and more narrow sails, especially for funboards, which require higher masts, usually with an extension of the mast from previously 4.50 m to about 4.90 m, which can be achieved with a mast extender arranged at the lower end of the mast. Furthermore, new stiffer materials are used for the sails, such as "Kevlar" and "Mylar". Such new sails are less extensible and require the use of larger forces for stretching the sail along the mast and along the boom (fore or mast leech and boom leech).

SUMMARY OF THE INVENTION

According to this invention these problems are solved by arranging in or at the lower end of the mast or a mast extender intended to be arranged at the lower end of the mast a force amplifying device for stretching and locking the fore end of the sail, i.e. the fore leech. With said force amplifier a fairly small force applied by hand can be amplified, for example with at least 50%, preferably at least 200% and especially at least 300% or 500%.

BRIEF DESCRIPTION OF THE DRAWINGS

FIG. 5 is a partial cross section view of a further preferred embodiment of the invention;

FIG. 6 is a side view of the device according to FIG. 5 viewed in a direction perpendicular thereto;

FIG. 7 is a view in a direction perpendicular to the view directions of FIGS. 5 and 6 of the device according to FIG. 5;

FIG. 10 is a side view of the device according to FIG. 2 arranged for tensioning a sail.

DETAILED DESCRIPTION OF THE PREFERRED EMBODIMENTS

Figure 1:
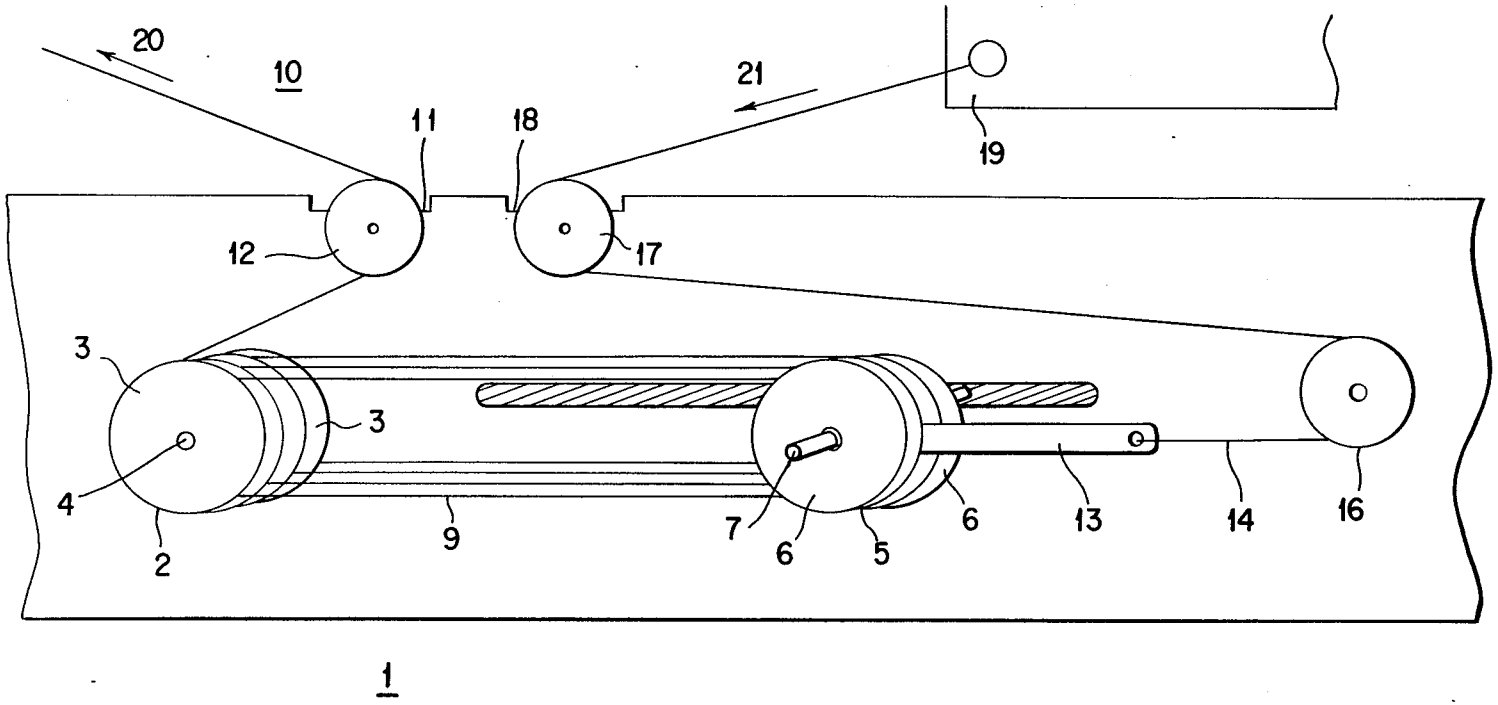
FIG. 1 is a partial cross section through a mast extender according to a first embodiment of the invention.

Preferably the force amplifier is arranged within the lower part of the mast or the mast extender. One such device is shown on FIG. 1 which is partly a section through a part 1 of a mast or mast extender and comprises a two-fold purchase with a fixed block 2 with 4 wheels 3 arranged in parallel on the same axis 4 which extends through holes in the mast (or extender) 1 and cooperates with a similar second block 5 with 4 wheels 6 arranged on the same axis 7 which extends through two longitudinal openings 8 in the mast. The two blocks 2 and 5 are connected with a rope 9 in the usual way for such a per se known device, and one end 10 of said rope extends through an opening 11 in the mast at which there is arranged a pulley wheel or a similar device which permits passing the rope out from the inside of the mast with a low friction. The movable block 5 is provided with a fastening means 13 for one end of a second rope 14, the other end 15 of which extends through an opening in the mast, preferably via a first pulley wheel 16 and a second pulley wheel 17 arranged at an opening 18 in the mast. The outer end 15 of the ropes 17 is secured to the tack 19 of a sail as is shown sketchily on the figures. A force applied in the direction of arrow 20 will thus cause an amplified force acting in the direction of the arrow 21 on the sail.

Figure 2:
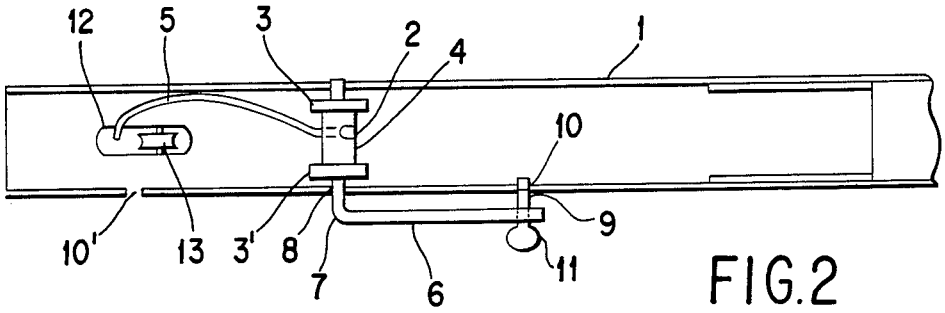
FIG. 2 is a partial cross section view of a preferred embodiment of the invention arranged in a mast device.
Figure 3:
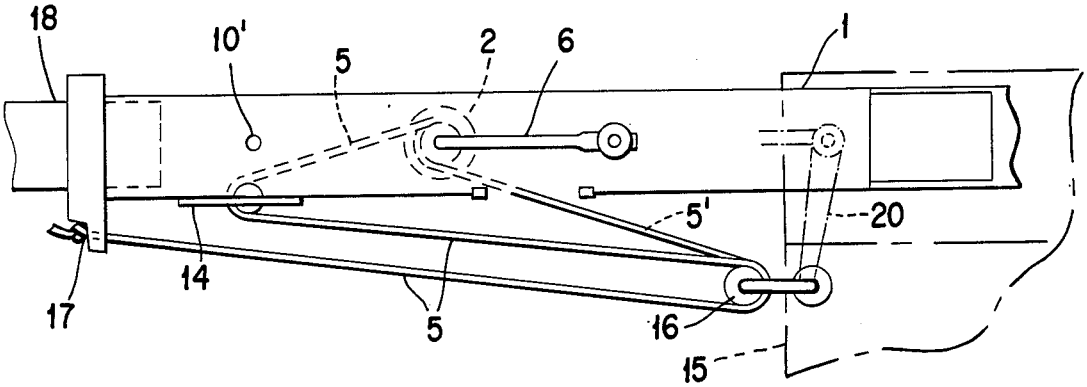
FIG. 3 is a side view of the embodiment according to FIG. 2.
Figure 4:
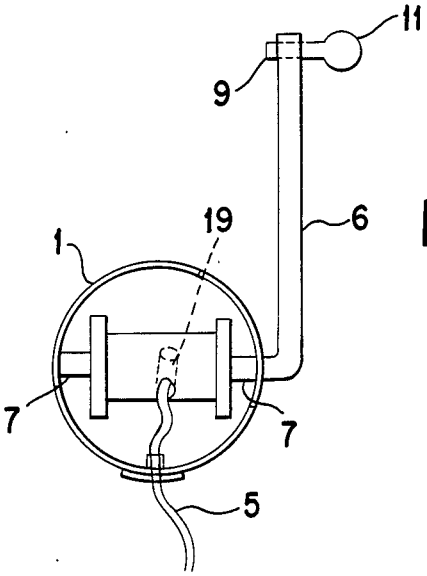
FIG. 4 is a view in the axial direction of the mast of the embodiment according to FIG. 2.

FIGS. 2–4 show a preferred embodiment of the invention according to which a mast extender 1 or a mast end is provided with a rope drum 2 with a cylindrical part 4 on which a rope 5 which is secured to the drum can be winded up by turning the rope drum 2. The rope drum may be provided with end flanges 3, 3' but these are not absolutely necessary and the drum may consist of a straight, preferably cylindrical shaft. The rope drum can be turned with the aid of a crank 6 or a fulcrum which is arranged on the outside of the mast extender or mast and is connected to the rope drum. According to the figure this connection is provided by a shaft 7 on which the rope drum is arranged, said shaft 7 being mounted in bearings in opening 8 in the mast extender or mast. Said openings may optionally be provided with bushings. The ends of the rope drum, such as the flanges 3, 3', may function as stopping means for the axial movement of the rope drum within the mast or mast extender. The end of the crank arm 6 is provided with a locking means, preferably consisting of a bolt 9, which is held slidably in an opening at the end of the crank arm 6 and can be displaced towards the mast extender or mast and be locked into a locking means thereon, which on the figures is shown as openings 10, 10' in the mast or extender wall. The device is provided with at least one such locking means 10, 10' and preferably with two locking means arranged one on each side of the rope drum in the longitudinal extension of the mast or extender, said locking means preferably being arranged essentially on a straight line in said longitudinal direction with the rope drum in the middle therebetween. The outer end of the displacable locking means 9 may be provided with a gripping means, such as a knob 11, a ring or a similar means in order to facilitate the gripping and turning of the crank 6. The rope 5 extends through an opening 12 in the mast or extender wall and is preferably passed over a pulley wheel 13 which may be arranged in a bracket 14 secured to the mast or extender wall. The outlet opening 12 is on FIGS. 2 and 3 shown arranged closer to the lower end than the rope drum 12 but may also be arranged at the same level or on a higher level, i.e. further away from the lower end of the mast or extender than the rope drum 12, in which case the pulley wheel 13 may be disposed of or substituted with a simpler bushing means arranged in the outlet opening for the rope, and the last-mentioned embodiment is indicated with a rope 5' shown with broken lines on FIG. 3.

The rope 5 is connected in a force-transferring way to the fore leech 15 of a sail, preferably with a pulley wheel 16 or a similar device, in which case the other end of the rope 5 is fastened at 17 to the lower end of the mast or extender, e.g. to the mast step 18 or preferably to a fastening means arranged at the mast or extender or the mast step and to which the rope 5 can easily be detachably secured, such as a clam cleat (not shown). By passing the rope over a pulley wheel 16 or a similar device the tension exerted on the sail 15 by the rope 5 will be increased to about two-fold of the tension exerted on the rope by the rope drum 2.

Before stretching the lower end of the sail towards the end of the mast or extender the rope is preferably winded off from the drum 2 to the full extent and the sail is then stretched with the aid of the free end of the rope 5, which is then locked in a locking device such as a clam cleat. The stretching of the sail is then continued by winding up the rope on the drum 2 until a suitable tension is obtained and the drum 2 is then locked by locking the crank arm 6 with locking means 9, 10. If a suitable tension cannot be obtained with the crank arm 6 in suitable position for locking, the end of the rope 5 is locked in the locking means in a new position which permits turning the crank arm 6 to a position in which the locking means 9, 10 can cooperate, with suitable tension exerted on the sail. It is usually preferable that the diameter of the rope drum is as small as possible so that the increment of rope winded up on the drum 2 is as small as possible for each 180° turn of the crank arm 6 and drum 2. Thus the diameter of the rope drum 2 may be selected to at most 30 mm, preferably at most 20 mm or at most 15 mm or at most 10 mm. The extension of the crank arm 6 should be sufficient for permitting the user to conveniently exert a suitable tension on the sail but should preferably be selected as small as possible in order to reduce the distance from the end of the mast or extender to the uppermost locking means 10 since usually the sail cannot be stretched below said uppermost locking means. A suitable extension of the crank arm 6 may be at least 50 mm, usually at least 75 mm but preferably at most 200 mm or at most 150 mm or at most 125 mm. The rope 5 may suitably be connected to the drum 2 by passing it through a hole 19 in the rope drum and being locked e.g. with a knot or a suitable locking means which cannot pass through said hole 19.

The means connecting the rope 5 with the sail 15 may also comprise an elastically resilient means, such as a rubber spring or a screw spring which optionally may be pre-stressed so that said spring means will be extended only when the tension in the rope 5 exceeds a desired lower limit.

The rope drum 2 may also be provided with other types of locking means, such as a ratchet means with release means, with which the drum may be locked in a suitable number of positions within each full turn of the drum 2. The crank arm 6 is then suitably releasably connected to the drum 2, e.g. with a free-wheel means or optionally completely removable from the drum 2 or axis 7. Furthermore, the locking means 10' and especially the upper locking means 10 may be supplemented with a locking means connected e.g. to the sail for holding the crank arm 6 in a proper position, preferably along the mast or in a position which preferably does not deviate more than 45° and especially not more than 30° or 20° from the length axis of the mast. Such a means is on FIG. 3 exemplified with a simple rope loop 20 indicated with broken lines with the position of the crank shaft 6 in relation to the sail likewise shown in broken lines. (The position of the crank arm 6 in this case is, of course, the position shown in full lines on FIG. 3). In this way the crank arm 6 can be locked in the upper position also when the sail is stretched down below the upper end of the crank arm and below the locking means 10.

The force amplifying device according to the invention comprising a rope drum enclosed in an elongated housing with a crank arm extending outside said housing and with locking means for locking the crank arm in at least one position and preferably at least two positions with the crank arm extending essentially in the longitudinal direction of the elongated housing is also ideally suited for other sailing devices than windsurfers and also for other purposes. Such a separate force amplifying device which can be arranged on a suitable location e.g. with bolts or screws is shown on FIGS. 5–7. An elongated housing 1 of rectangular cross section comprises a rope drum 2 connected to a shaft 7 resting in bearings 8 in the wall of the housing consisting of openings in said housing which may be provided with bushings. The device comprises essentially the same elements as the device disclosed on FIGS. 2–4, such as a crank arm 6 with locking means 9 cooperating with locking means 10 and 10' consisting of openings in the wall of the housing into which the locking means 9, which consists of a bolt, can be inserted. The outer end of the locking means 9 is also provided with a knob or a ring or a similar means which facilitates gripping and handling. The rope 5 can be passed out from the housing through the open ends of the housing or through one or more openings 22 arranged in the upper wall 23 of the housing, as indicated with the rope 5'. The device can be secured to a suitable support with screws or bolts through openings 24.

Figure 8:
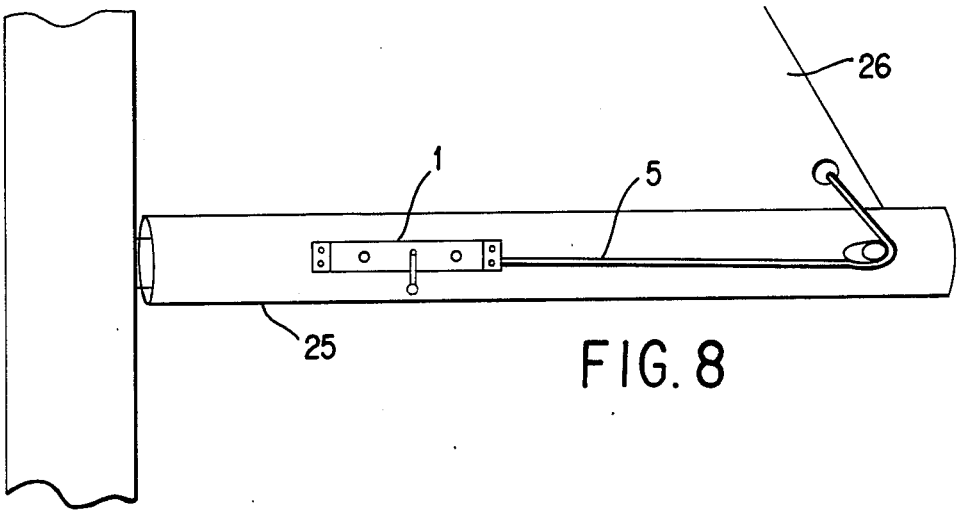
FIG. 8 is a side view of the device according to FIG. 5 arranged on a sail-boom.
Figure 9:
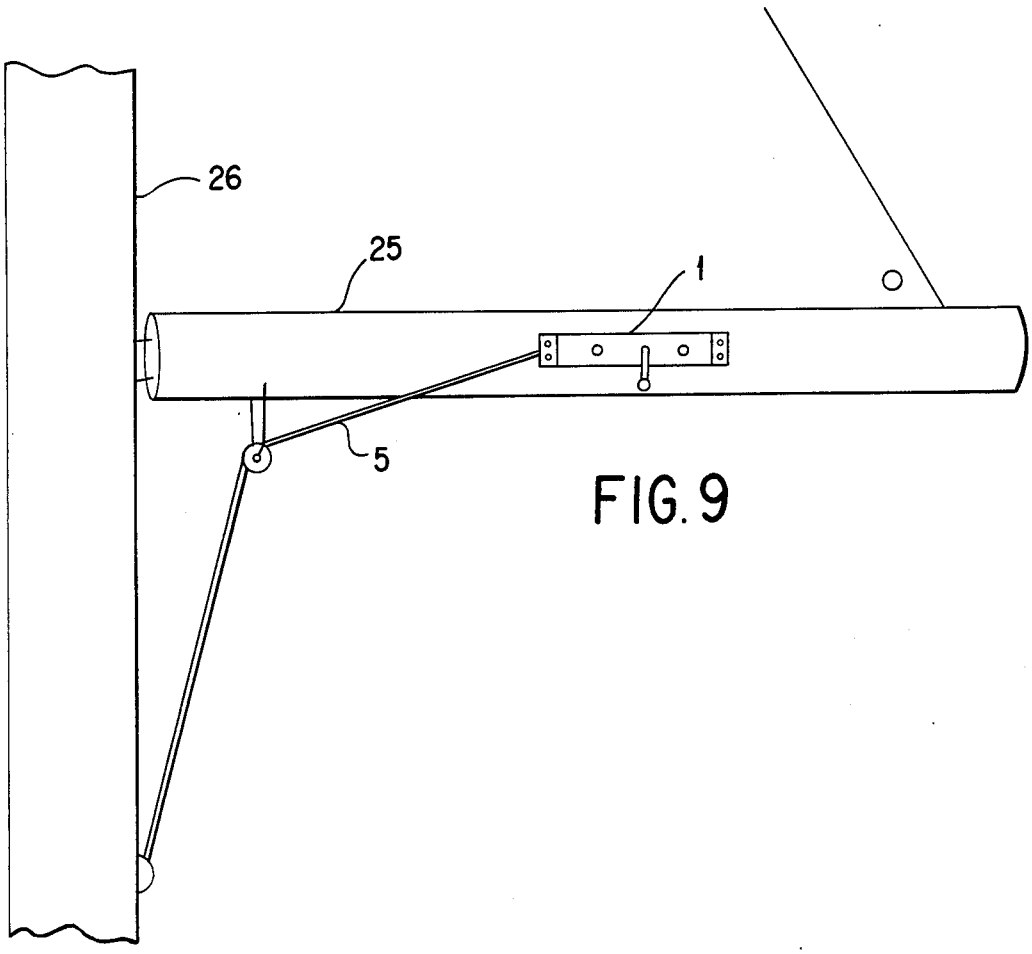
FIG. 9 is a side view of the device according to FIG. 5 arranged on a sail-boom.

FIG. 8 shows said device secured to a boom 25 of a sailing boat with the device used for stretching a sail 26. FIG. 9 shows the same device arranged for hauling down the boom 25 along a mast 26.

FIG. 10 shows the device according to FIGS. 2–4 arranged in a mast extender 1, to which is secured a mast 27. The same reference numbers are used as on said figures for various parts. The end of the rope 5 is releasably secured to a clam cleat 28. Furthermore, the end of the mast extender is connected to a rubber joint 29 provided with a screw 30 intended to be joint to a mast foot (mast step) intended to be secured to a windsurfing board.

The ratio of the distance from the end of the crank arm 6 or knob 11 to the centre of the shaft 7 relative to the radius of the rope drum 2 and thus the theoretical force amplification is preferably at least 2:1, especially at least 4:1 or at least 6:1 or even at least 8:1 or at least 10:1.

I claim:

1. A force amplifying device which comprises a rope drum for winding up a rope under tension arranged in an elongated housing with an axis of said rope drum directed essentially perpendicular to a longitudinal extension direction of said elongated housing, an elongated crank arm arranged outside said housing and extending a maximum of 200 mm from said axis of said rope drum and being connected to said rope drum for turning said rope drum and winding up a rope under tension on said rope drum, a ratio of a distance from a handle at an end of the crank arm to said axis relative to a radius of said rope drum being at least 4:1, and locking means for locking the crank arm in at least one of two directions which substantially coincide with the longitudinal extension direction of the elongated housing, said locking means comprising a bolt which is arranged slidably in an opening at the end of the crank arm in a transverse direction to said crank arm, said bolt being movable from an outer position in which the bolt acts as said handle for facilitating the gripping and turning of the crank arm, and towards said housing to an inner position in which the bolt fits into a locking opening in the housing for locking the crank arm in said at least one of said two directions which substantially coincide with the longitudinal direction of the elongated housing.

2. A force amplifying device according to claim 1 arranged for stretching sail or riggings of a sailing device.

3. A force amplifying device according to claim 2 which forms a part of a mast device comprising a mast extender for a windsurfing device.

4. A force amplifying device according to claim 2 which forms a part of the lower end of a mast for a windsurfing device.

5. A force amplifying device according to claim 1 in which said housing comprises a lower end part of a tubular mast device for connection to a windsurfing device, the longitudinal direction of said housing being the longitudinal axis of said mast device, said rope drum being arranged within said housing on a shaft supported in bearing means including openings in a wall of said tubular mast device, and at least one said opening in the wall of the tubular mast device adapted for passing the rope slidably out through said opening, said opening being arranged in a position from which the rope, with one end connected to the rope drum, can be connected to a lower foremost end of a sail for tensioning said sail towards said lower end of said mast device.

6. A force amplifying device according to claim 1 in which the ratio of distance from the handle at the end of the crank arm to the radius of the rope drum is at least 6:1.

7. A force amplifying device according to claim 6 in which the said ratio is at least 8:1.

8. The use of a device according to claim 1 for stretching sails and riggings on a sailing device.

9. A force amplifying device according to claim 1 including two locking openings in the housing for locking the crank arm in said two directions which substantially coincide with the longitudinal direction of the elongated housing, with said openings being on opposite sides of the axis of said rope drum.

* * * * *